US005730043A

United States Patent [19]

Kristensen et al.

[11] Patent Number: 5,730,043

[45] Date of Patent: Mar. 24, 1998

[54] HYDRAULIC AXIAL PISTON MOTOR WITH PISTON-CYLINDER ARRANGEMENT LOCATED BETWEEN THE CYLINDER DRUM AND THE CONTROL PLATE

[75] Inventors: Egon Kristensen; Hardy Peter Jepsen, both of Nordborg, Denmark

[73] Assignee: Danfoss A/S, Nordborg, Denmark

[21] Appl. No.: 656,188

[22] PCT Filed: Nov. 30, 1994

[86] PCT No.: PCT/DK94/00446

§ 371 Date: Jul. 24, 1996

§ 102(e) Date: Jul. 24, 1996

[87] PCT Pub. No.: WO95/16131

PCT Pub. Date: Jun. 15, 1995

[30] Foreign Application Priority Data

Dec. 8, 1993 [DE] Germany ..... 43 41 845.7

[51] Int. Cl.[6] ..... F01B 13/04; F04B 1/20

[52] U.S. Cl. ..... 92/57; 91/499; 417/269

[58] Field of Search ..... 91/499; 417/269; 92/57, 71

[56] References Cited

U.S. PATENT DOCUMENTS

| | | | |
|---|---|---|---|
| 2,672,095 | 3/1954 | Lucien et al. | 417/269 |
| 2,915,985 | 12/1959 | Budzich | 92/57 |
| 3,468,263 | 9/1969 | Niemiec | 91/499 |
| 4,478,134 | 10/1984 | Kawahara et al. | 91/499 |
| 5,079,993 | 1/1992 | Forster | 91/484 |
| 5,528,977 | 6/1996 | Goade | 417/269 |
| 5,540,139 | 7/1996 | Martensen et al. | 92/57 |
| 5,588,347 | 12/1996 | Jepsen | 91/499 |
| 5,622,097 | 4/1997 | Martensen et al. | 92/71 |

FOREIGN PATENT DOCUMENTS

| | | | |
|---|---|---|---|
| 2459075 | 6/1976 | Germany | 92/57 |
| 181057 | 10/1962 | Sweden | 92/71 |

*Primary Examiner*—Timothy Thorpe
*Assistant Examiner*—Peter G. Korytnyk
*Attorney, Agent, or Firm*—Lee, Mann, Smith, McWilliams Sweeney & Ohlson

[57] ABSTRACT

A hydraulic axial piston motor is disclosed, having a rotatable cylinder drum, in which several work pistons, each provided at one end with a slider shoe, are arranged in work cylinders so as to be axially movable, having a control plate, a swash plate, against which the slider shoes bear, a pressure plate which holds the slider shoes on the swash plate, and a pressure-applying unit, which acts on the pressure plate and comprises a hydraulic piston-cylinder arrangement. Using such a motor it is desirable for an adequate contact pressure to be produced using simple means. For that purpose, the piston-cylinder arrangement is arranged between the cylinder drum and the control plate.

9 Claims, 2 Drawing Sheets

HYDRAULIC AXIAL PISTON MOTOR WITH PISTON-CYLINDER ARRANGEMENT LOCATED BETWEEN THE CYLINDER DRUM AND THE CONTROL PLATE

BACKGROUND OF THE INVENTION

The invention relates to a hydraulic axial piston motor having a rotatable cylinder drum, in which several work pistons, each provided at one end with a slider shoe, are arranged in work cylinders so as to be axially movable, having a control plate, a swash plate against which the slider shoes bear, a pressure plate which holds the slider shoes against the swash plate, and a pressure-applying unit, which acts on the pressure plate and comprises a hydraulic piston-cylinder arrangement.

In operation, the work cylinders are supplied with hydraulic fluid under pressure, under the influence of which the work pistons are pushed out of the work cylinders. The work pistons lie via the intermediary of their slider shoes against the swash plate. Because the swash plate takes up a predetermined or adjustable angle with respect to the direction of the axis of the cylinder drum, an effective force resulting from the slant is consequently produced, which with its lever arm acts in the form of a rotary torque on the cylinder drum and turns this. To reduce friction, a small part of the hydraulic fluid introduced into the work cylinders is often passed right through the piston to the sliding face of the slider shoes, in order there to build up a lubricating film or to effect pressure relief, for example as a result of hydrostatic lubrication. In order, inter alia, not to let the resulting losses due to leakage become too great, and also for other reasons, for example, the control behaviour of the motor or to counteract centrifugal forces, it is important to keep the slider shoes in contact with the swash plate at all times. The pressure plate, which is pressurized by the pressure-applying unit with a pressure force, is used for that purpose. This pressure force must not, on the one hand, be large enough to increase the friction losses between slider shoes and swash plate unnecessarily, but on the other hand it must be large enough to counteract the tendency of the slider shoes to lift away at least partially from the swash plate at higher speeds.

Since such an adjustment of the pressure force solely by means of a spring is virtually impossible, DE 39 01 064 A1 discloses in addition a hydraulic piston-cylinder arrangement which can be supplied with pressures of different levels in dependence on the speed of the motor. At low speeds, it is possible to ensure that the contact pressure of the slider shoes against the swash plate is also low, which leads to correspondingly low friction losses. At higher speeds, the pressure is correspondingly increased, so that the slider shoes are unable to lift away from the swash plate.

The axial piston machine according to DE 39 01 064 A1 has as its pressure-applying unit a concave bearing for the pressure plate which is mounted so as to be axially displaceable on a shaft carrying the cylinder drum. Pressure is exerted on the bearing by an annular piston by way of bolts, the annular piston being arranged in a ring-shaped cylinder in the cylinder drum within a circle formed by the work cylinders and surrounding the shaft. Upon an increase in pressure in the cylinder, the piston is loaded in a direction towards the bearing. A corresponding pressure force is therefore exerted by way of the bearing on the pressure plate. In the ring-shaped cylinder there is furthermore arranged a compression spring which ensures that the bearing is biassed. The annular piston has, however, a relatively small face on which pressure can act so that either the desired increase in contact pressure cannot be achieved or the hydraulic fluid has to be supplied at relatively large pressures. This is not quite without problems because the high pressures still have to be changed in dependence on the operational behaviour of the motor.

SUMMARY OF THE INVENTION

The invention is therefore based on the problem of providing an axial piston motor in which a sufficiently large contact pressure can be produced using simple means.

The problem is solved in an axial piston motor of the kind mentioned in the introduction in that the piston-cylinder arrangement is arranged between the cylinder drum and the control plate.

As a result, the piston-cylinder arrangement can have virtually the same dimension as the cylinder drum. The face of the piston-cylinder arrangement on which pressure can act is consequently large so that even at low pressures of the hydraulic fluid an adequately large contact pressure can be achieved.

In a preferred construction, the piston-cylinder arrangement has a work chamber which is continually pressurized with a pressure at the hydraulic output port of the motor. With this arrangement, speed-dependent control of the pressure in the work chamber is achieved in a very simple manner, because the output pressure of the motor substantially follows the speed. At low speeds, the pressure in the work chamber is consequently so low that the sliding friction between the slider shoes and the swash plate, and the friction losses associated therewith, remain low. If the speed increases, and thus also the tendency of the slider shoes to lift away from the swash plate because of the centrifugal force, or at least their tendency to incline themselves relative to the plate, the pressure in the work chamber is also increased, so that the pressure plate acts with a higher pressure on the slider shoes and holds these better on the swash plate. This matching of the pressure is effected automatically without further intervention. Moreover, the residual pressure still present at the output port of the motor, which would otherwise be lost when returning hydraulic fluid to the tank, is utilized.

It is here preferable for a throttle to be arranged in the output port of the motor and for the work chamber to be connected to the area upstream of the throttle. The throttle produces a flow-dependent pressure drop. A flow-dependent pressure accordingly builds up upstream of the throttle. The flow rate of the hydraulic fluid is, however, substantially directly related to the speed of the motor. Using the throttle, the pressure in the work chamber is able to rise there without detriment to the matching of the pressure to speed. With suitable throttles, a non-linear correlation between the pressure prevailing in the work chamber and the speed can also be produced.

Preferably, the control plate has a control kidney connected to the output port, which is in pressure or fluid connection with an annular channel, which in turn is in pressure or fluid connection with the work chamber. Irrespective of the rotated position, a permanent pressure or fluid connection is ensured between the work chamber and the output port through the annular channel. The annular channel can in that case be provided both in the control plate and in the side of the piston-cylinder arrangement facing the control plate. It may have a relatively small cross-section, because the connection from the output port to the work chamber serves virtually only to transfer pressure.

Preferably, in the flow path between each work cylinder and the control plate there is provided a connector bush which passes at least partially through the piston-cylinder arrangement. Despite the fact that it is possible to use a face on which pressure can act of virtually the same size as the end face of the cylinder drum, trouble-free transport of the hydraulic fluid from the control plate to the individual work cylinders is ensured.

It is especially preferred for the connector bush to be inserted in the work cylinders and to pass through one of the two components piston and cylinder and to be inserted into the other one of the two components cylinder and piston; a supply channel that opens out into the connector bush and passes through the first component is provided in this other component. In this arrangement, on the one hand a non-rotatable connection of the piston-cylinder arrangement with the cylinder drum is ensured, so that control of the motor, which is effected through cooperation of the individual control "kidneys" in the control plate with inlet openings to the work cylinders, remains virtually unaltered compared with motors without the piston-cylinder arrangement between cylinder drum and control plate. The connector bushes firstly provide a safeguard against the cylinder drum, the piston and the cylinder rotating relative to one another. Secondly, together with the supply channel, the connector bush forms the flow path for the hydraulic fluid from the control plate to the work cylinder. Because the connector bush is inserted in the work cylinder, it provides there a face on which pressure can act for the pressure prevailing in the work cylinder, which ensures that the connector bush is always pressed into the piston-cylinder arrangement. Complicated measures for securing the connector bush are therefore unnecessary. It need hardly be mentioned that the connector bush should be sealed with respect to the work cylinder and with respect to the piston-cylinder arrangement in order to prevent escape of hydraulic fluid during operation of the motor from the flow path between the control plate and work cylinder.

Preferably, the piston-cylinder arrangement acts on the pressure plate by way of at least one pusher rod and a bearing, on which the pressure plate is pivotally mounted. The pusher rod requires relatively little space in the cross-sectional area of the cylinder drum. It can be arranged between individual work cylinders. In this manner, despite the relatively large face on which pressure can act that is provided by the piston-cylinder arrangement, it is possible to transfer the pressure force through the cylinder drum to the bearing and consequently to the pressure plate.

Preferably, the contact unit has a biassing spring arranged between the pressure plate and the piston-cylinder arrangement. This biassing spring produces a pressure independent of the operational state of the motor. The slider shoes are therefore pressed against the swash plate with a certain force even when the motor is not operational.

The biassing spring preferably surrounds the pusher rod for at least a part of its length and bears against a projection formed on the pusher rod. The biassing spring is therefore securely guided. The spring force is transferred directly to the pusher rod, from where it can act via the intermediary of the bearing directly on the pressure plate.

BRIEF DESCRIPTION OF THE DRAWINGS

The invention is described hereinafter with reference to a preferred embodiment. In the drawings.

DESCRIPTION OF AN EXAMPLE EMBODYING THE BEST MODE OF THE INVENTION

Figure 1:
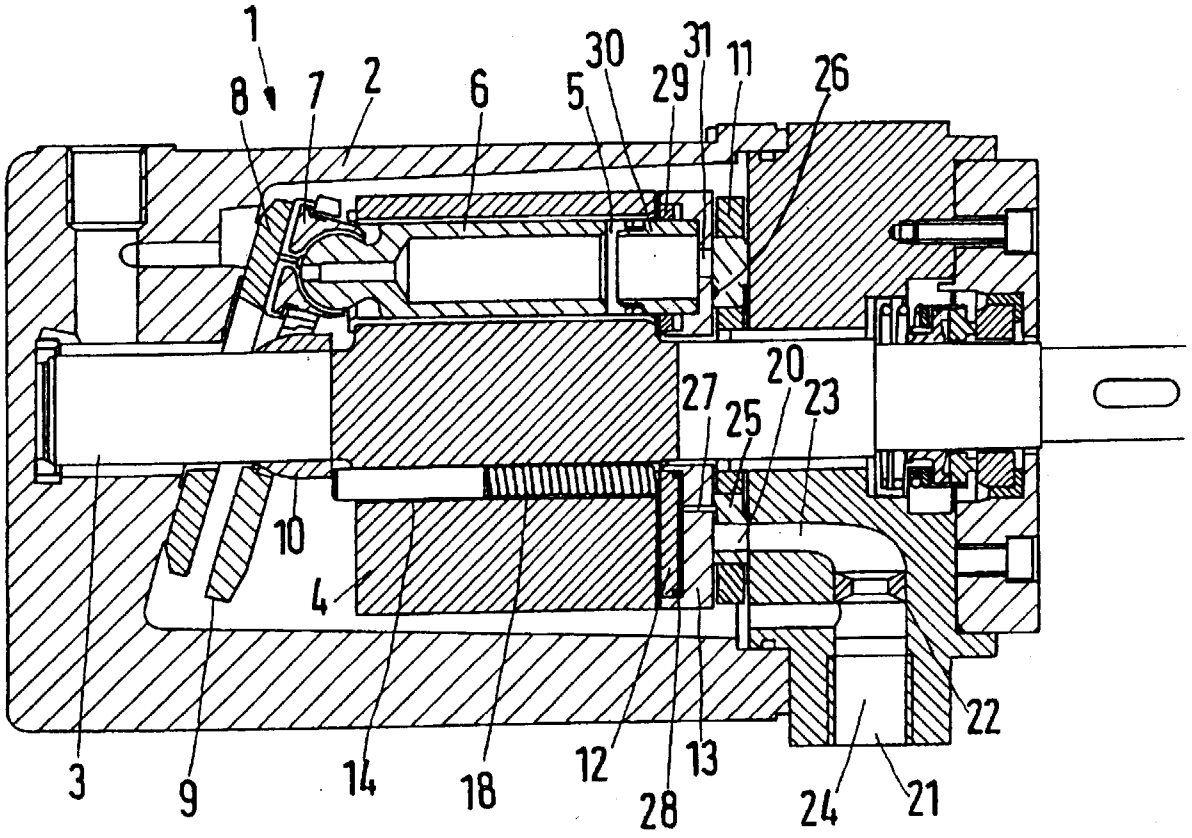
FIG. 1 shows an axial piston motor in cross-section.

An axial piston motor 1 has in a housing 2 a rotatably mounted shaft 3 which is connected to a cylinder drum 4 so that they rotate together. In this particular embodiment, the cylinder drum 4 is also axially fixedly mounted on the shaft 3.

Several work cylinders 5 are arranged in the cylinder drum 4 distributed around the circumference thereof. In each work cylinder a work piston 6 is mounted so as to be axially displaceable. Each work piston 6 bears on a swash plate 8 via the intermediary of a slider shoe 7, which is articulated at the end of the work piston 6 projecting from the cylinder drum.

In order to ensure reliable positioning of the slider shoes 7 on the swash plate 8, a pressure plate 9 is provided, which is pivotally arranged on a spherical bearing 10 which is mounted on the shaft 3 so as to rotate and so as to be axially displaceable.

On the side of the cylinder drum opposing the slider shoes there is arranged a control plate 11. Between the control plate 11 and the cylinder drum 4 there is a cylinder-piston arrangement, which is constituted by a piston 12 and a cylinder 13. In this case, the cylinder 13 lies against the control plate 11, while the piston 12 is directed towards the cylinder drum 4. Of course, this arrangement can also be reversed.

Figure 4:
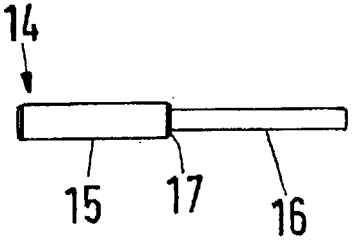
FIG. 4 shows a pusher rod.

Between the piston 12 and the bearing 10 there is arranged a pusher rod 14, shown in greater detail in FIG. 4. The pusher rod 14 has a first portion 15 and a second portion 16 of smaller diameter than the first portion 15. Between the two portions 15, 16 there is formed a projection 17 against which a compression spring 18 bears. The compression spring 18 bears at its other end against the piston 12. The compression spring 18 acts as a biasing spring which exerts a certain pressure force on the bearing 10 and consequently also on the pressure plate 9 in all operational states of the motor 1, even when this is inoperative.

Figure 2:
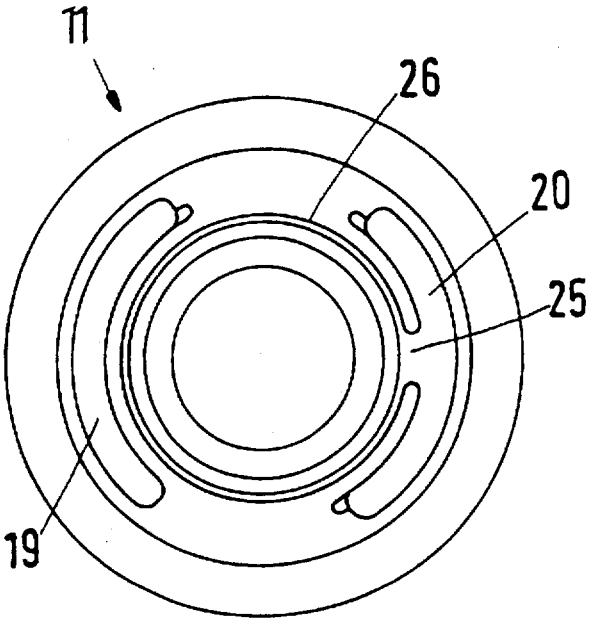
FIG. 2 is a plan view of a control plate viewed from the left in the orientation shown in FIG. 1.

The control plate 11 (see FIG. 2) has, as is customary, an inlet kidney 19 and an outlet kidney 20. The outlet kidney 20 is connected to an output port 21 of the motor. A throttle 22 which divides the output port 21 into a region 23 of relatively high pressure and a region 24 of relatively low pressure is arranged in the output port 21. The pressure differences are not apparent, however, until hydraulic fluid flows through the output port 21.

The outlet kidney 20 is connected by way of an intermediate channel 25 to an annular channel 26 in which the pressure is always the same as the pressure in the region 23 of relatively high pressure of the output port 21.

In the cylinder 13 at the same radial position as that at which also the annular channel 26 is arranged, there is provided a continuous bore 27, so that the annular channel 26 is permanently in fluid connection with a pressure chamber 28 between the piston 12 and the cylinder 13. The pressure in the pressure chamber 28 is therefore always the same as in the region 23 of relatively high pressure of the output port 21.

Figure 3:
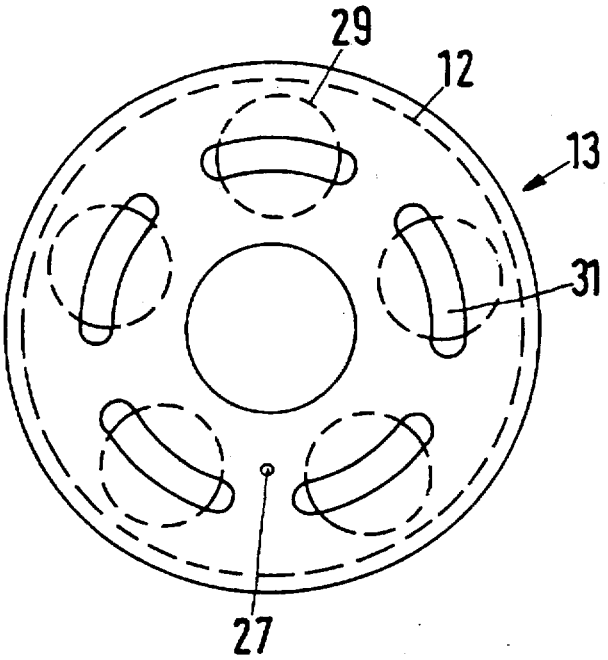
FIG. 3 is a plan view of the piston-cylinder arrangement viewed from the right in the orientation shown in FIG. 1.

As is apparent from FIG. 3, in which the outline of the piston 12 is indicated by a broken line, the piston 12 has a number of openings 29 corresponding to the number of work cylinders 5. A connector bush 30 passes through each opening 29 and at one side is inserted, sealed, in the work cylinder 5 and at the other side is inserted, sealed, in the piston 13. Seals, not shown more specifically, ensure that the connector bush is sealed with respect to the cylinder drum 4 and the piston 12. The connector bush 30 is formed by a hollow cylinder which is open at both ends. One opening opens into the work cylinder 5. The other opening, on the right in FIG. 1, is connected to a supply channel 31, which in its turn is arranged so that it passes over the inlet kidney 19 and the outlet kidney 20 on rotation of the cylinder drum. The supply channel 31 fulfils the same function as the correspondingly constructed end-face opening of the work cylinder 5 in conventional axial piston machines. The connector bushes 30 ensure a non-rotatable connection of the cylinder drum 4, piston 12 and cylinder 13, that is to say, rotation of these parts relative to one another is reliably prevented. The axial piston motor 1 can therefore be controlled in exactly the same manner as conventional machines.

The use of the connector bush 30 also means that the cylinder 13 is able to press better against the control plate 11, which in turn leads to fewer leaks and consequently to an improved efficiency of the motor.

If a pressure builds up in the work chamber 28 of the piston-cylinder arrangement 12, 13, the piston is pressurized with a force that is directed in FIG. 1 towards the left. This force is transferred by way of the pusher rod 14 to the bearing 10 and consequently to the pressure plate 9. At the same time, a corresponding counter-force acts on the cylinder 13, which is accordingly pressed against the control plate 11.

The flow rate of the fluid which flows through the output port 21 is dependent on the speed of the axial piston motor. The faster the motor turns, the larger is the amount of fluid that must flow away per unit of time. The pressure in the region 23 of relatively high pressure is accordingly changed by the throttle 22 in dependence on speed, this dependency normally being non-linear. At a higher speed of the motor, there is, however, in any case a higher pressure in the region 23 of relatively high pressure and consequently a correspondingly higher pressure in the work chamber 28 of the piston-cylinder arrangement 12, 13. At higher speeds, the slider shoes consequently also bear in an improved manner against the swash plate 8 with the assistance of the pressure plate 9. At lower speeds, this pressure force is reduced. When the motor is at a standstill, only the force applied by the compression spring 18 is effective.

The embodiment illustrated can be modified in many respects. The throttle 22 can also be created by the constructional form of the output port 21. The piston-cylinder arrangement can be reversed so that the piston bears against the control plate while the cylinder is adjacent to the cylinder drum. More or fewer pusher rods 14 can be used, although in many cases three pusher rods and three compression springs will be needed, but will be adequate in number.

We claim:

1. A hydraulic axial piston motor having a rotatable cylinder drum, in which several work pistons, each provided at one end with a slider shoe, are arranged in work cylinders and are axially movable therein, and having a control plate, a swash plate against which the slider shoes bear, a pressure plate which holds the slider shoes against the swash plate, and a pressure-applying unit which acts on the pressure plate and comprises a hydraulic piston-cylinder arrangement, the piston-cylinder arrangement being located between the cylinder drum and the control plate.

2. A motor according to claim 1, in which the piston-cylinder arrangement has a work chamber which is subject to a continual pressure from a hydraulic output port of the motor.

3. A motor according to claim 2, in which a throttle is located in the output port of the motor and the work chamber is connected to a region upstream of the throttle.

4. A motor according to claim 2, in which the control plate has a control kidney connected to the output port, which is in connection with an annular channel, which in turn is in connection with the work chamber of the piston-cylinder arrangement.

5. A motor according to claim 1 in which a flow path between each work cylinder and the control plate there is provided a connector bush which passes at least partially through the piston-cylinder arrangement.

6. A motor according to claim 5, in which the connector bush is inserted in the work cylinder and passes through one of the piston and cylinder of the piston-cylinder arrangement and is inserted into the other of the cylinder and piston, and including a supply channel that opens into the connector bush.

7. A motor according to claim 1 in which the piston-cylinder arrangement acts on the pressure plate by means of at least one pusher rod and a bearing, on which the pressure plate is pivotally mounted.

8. A motor according to claim 1 including a biasing spring between the pressure plate and the piston-cylinder arrangement.

9. A motor according to claim 8, in which the biasing spring surrounds the pusher rod for at least a part of its length and bears against a projection formed on the pusher rod.

* * * * *